US005421757A

United States Patent [19]

Basiliere

[11] Patent Number: 5,421,757

[45] Date of Patent: Jun. 6, 1995

[54] RESCUE RAFT

[76] Inventor: Donald Basiliere, 150 North Ave., Haverhill, Mass. 01830

[21] Appl. No.: 236,453

[22] Filed: May 2, 1994

[51] Int. Cl.[6] ..... B63B 17/00

[52] U.S. Cl. ..... 441/39; 441/128; 441/80

[58] Field of Search ..... 441/128, 129, 136, 80, 441/35, 40, 39; 5/82

[56] References Cited

U.S. PATENT DOCUMENTS

| | | | |
|---|---|---|---|
| 237,693 | 2/1881 | Oliver | 441/128 |
| 2,519,376 | 8/1950 | Jennings . | |
| 3,133,295 | 5/1964 | Klingensmith . | |
| 3,343,189 | 9/1967 | Pollard et al. . | |
| 3,370,310 | 2/1968 | La Tour . | |
| 4,332,049 | 6/1982 | Fisher | 441/80 |
| 4,347,635 | 9/1982 | Eisenhauer | 441/40 |
| 4,466,145 | 8/1984 | Jones et al. | 5/82 R |
| 4,642,061 | 2/1987 | Arney | 441/83 |
| 4,717,362 | 1/1988 | Kraft | 441/80 |
| 4,753,620 | 6/1988 | Arney | 441/83 |
| 5,158,489 | 10/1992 | Araki et al. | 441/80 |
| 5,301,630 | 4/1994 | Genovese et al. | 441/80 |

*Primary Examiner*—Jesus D. Sotelo
*Attorney, Agent, or Firm*—Cesari & McKenna

[57] ABSTRACT

A rescue raft that includes a buoyant, elongated floor and a pair of parallel air chambers or pontoons on each side thereof is disclosed. Together, the floor and the parallel flotation members possess sufficient buoyancy to prevent the raft and a victim thereon from sinking. The raft also includes series of graspable members, extending across the floor and distributed sequentially along its longitudinal extent, that facilitate a victim's entry onto the raft and, when oriented vertically, form a ladder that assists entry onto a rescue boat. In a first embodiment, the graspable members are a series of cut-out windows through the raft floor. In a second embodiment, similar windows are formed by transverse inflatable rungs secured to the parallel air chambers. In a third embodiment, the windows are replaced with buoyant segments or cushions that project from the floor. And in a fourth embodiment, the graspable members are straps that extend transversely across the floor, at least some of which may be drawn around the victim.

19 Claims, 6 Drawing Sheets

RESCUE RAFT

BACKGROUND OF THE INVENTION

1. Field of the Invention

The present invention relates to rescue of victims from open water, and more particularly to a buoyant structure that may be deployed from a rescue vessel or from shore, and which is designed for easily managed use by persons in distress.

2. Description of the Related Art

Retrieval of accident victims from open water has always presented significant difficulties. These, of course, vary with the condition of the victim, his proximity to lifesaving craft where medical attention may be rendered, the turbulence of the water, water temperature, weather conditions, and the possible presence of marine predators. In order to accommodate such shifting constraints, which frequently impose contradictory rescue requirements, designers of rescue apparatus have developed a number of different devices for use in different circumstances.

The traditional "litter," a rigid framework of braces and interlacing metal bars, has become standard equipment on rescue helicopters due to its rugged construction and load-bearing capacity. These features reduce the possibility that the rescue operation itself will inflict spinal or skeletal injury. Side frames prevent the victim from rolling off the litter, and can also accommodate straps to further secure the victim.

Unfortunately, the same metal construction that protects victims also makes the litter difficult to handle and maneuver. The traditional litter is also, of course, nonbuoyant, limiting its usefulness in marine rescues. To address at least this limitation, designers have incorporated flotation devices onto the sides of the litter frame; see, e.g., U.S. Pat. Nos. 2,519,376, 3,133,295 and 3,343,189. However, floating litters are still cumbersome devices, suffering from the disadvantages associated with any piece of heavy equipment. The frame construction is particularly problematic in open water, where a victim must ascend over the side bars and into the device. It is also likely that at least part of the litter cage will, under the weight of a victim, sink into the water, continuing the victim's exposure thereto.

Devices that more easily accommodate a victim's entry offer significant operational advantage in adverse weather conditions, but can be very complex in construction. For example, U.S. Pat. Nos. 4,642,061 and 4,753,620 both contemplate a net enclosure for retaining the victim and various pontoons and arches to maintain the devices in an upright orientation.

Another construction offering simplified access to victims is disclosed in U.S. Pat. No. 4,717,362. This device provides a series of "flexible grab means" that the victim may use to draw himself onto its surface. However, although buoyant, this design is fully solid, resulting in much of the same awkwardness associated with conventional litters. Furthermore, the '362 device does not provide reliable means for securing the victim thereon, nor is it even shaped to prevent the victim from rolling off.

Accordingly, presently available rescue devices fail to combine features that ensure easy re-entry onto a boat, handling by rescuers, convenient transportation, and ready access to and secure retention of victims in open water.

DESCRIPTION OF THE INVENTION

Objects of the Invention

It is, therefore, an object of the invention to provide a rescue raft that offers lightweight construction and convenient handling.

It is another object of the invention to enable victims of marine accidents to draw themselves onto a rescue raft and secure themselves thereto.

It is yet another object of the invention to provide a rescue raft that is configured to enable the overboard victim to easily return onto the boat.

It is a further object of the invention to provide a rescue raft that may be easily retrieved from the water onto a rescue vessel.

Yet another object of the invention is to provide a buoyant rescue device that maintains a marine-accident victim fully above the surface of the water, and which affords means for preventing the victim from rolling off the raft.

It is still another object of the invention to provide a rescue raft suitable for use with a variety of rescue craft.

Other objects will, in part, be obvious and will, in part, appear hereinafter. The invention accordingly comprises an article of manufacture possessing the features and properties exemplified in the constructions described herein and the several steps and the relation of one or more of such steps with respect to the others and the apparatus embodying the features of construction, combination of elements and the arrangement of parts which are adapted to effect such steps, all as exemplified in the following detailed description, and the scope of the invention will be indicated in the claims.

BRIEF SUMMARY OF THE INVENTION

In accordance with the present invention, a rescue raft includes a buoyant, elongated floor and a pair of parallel air chambers or pontoons disposed on opposite sides thereof. Together, the floor and the parallel flotation members possess sufficient buoyancy to prevent the raft and a victim thereon from sinking. The raft also includes series of graspable members, extending across the floor and distributed sequentially along its longitudinal extent, to facilitate a victim's entry onto the raft and thereafter onto a rescue craft. In operation, a victim grasps these members, hand over hand, to haul himself onto the raft floor. Straps are provided to secure the victim to the raft when necessary, and an associated lifting assembly permits the raft to be hoisted onto a rescue boat or by helicopter.

In a first embodiment, the graspable members are a series of cut-out windows that extend through the raft floor. In a second embodiment, similar windows are formed by transverse inflatable rungs secured to the parallel air chambers. In a third embodiment, the windows are replaced altogether with buoyant segments or cushions that project from the floor. And in a fourth embodiment, the graspable members are straps that extend transversely across the floor, at least some of which may be drawn around the victim.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
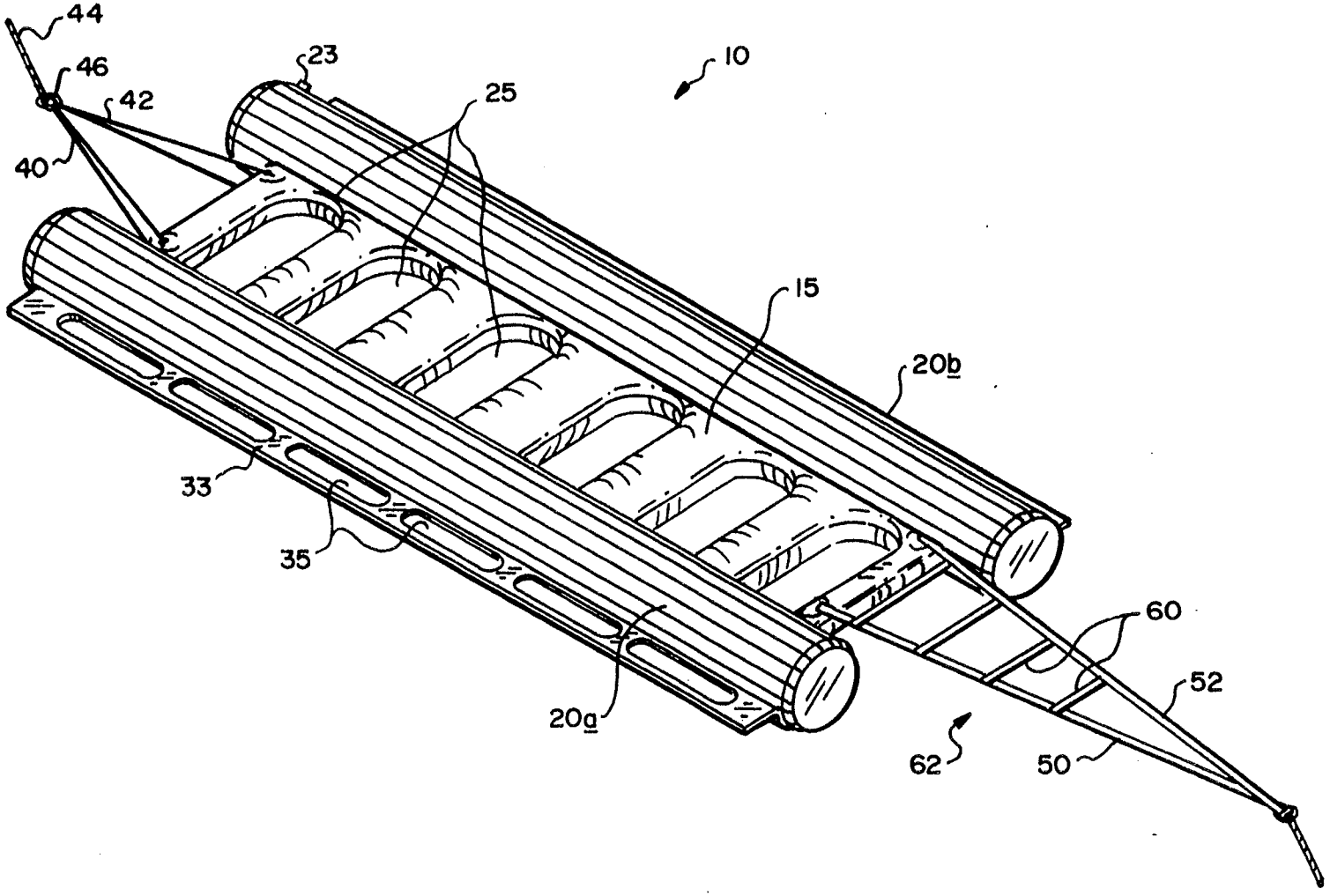
FIG. 1 is an isometric view of a first embodiment of the present invention.
Figure 2:
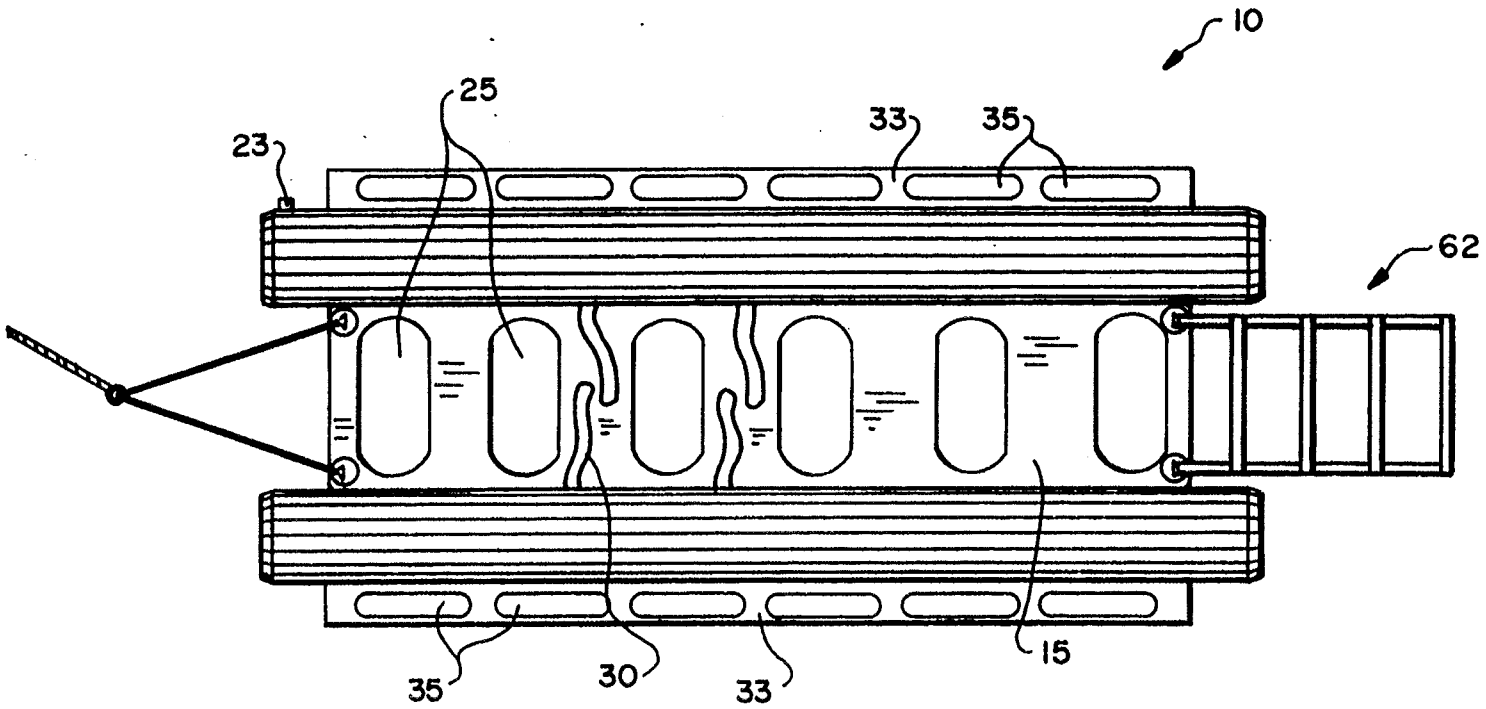
FIG. 2 is a plan view of the device depicted in FIG. 1.

Refer first to FIGS. 1 and 2, which illustrate a first embodiment of the present invention, denoted generally by reference numeral 10. As shown in both figures, the raft 10 comprises a body or floor 15 of generally elongate, rectangular dimension, flanked on each side by a cylindrical flotation member 20*a*, 20*b* attached thereto and extending at least its longitudinal length. Both floor 15 and flotation members 20*a*, 20*b* are preferably hollow and inflatable, and fabricated from sturdy, tear-resistant material, ideally urethane-coated fabric but alternatively a heavy vinyl or plastic. When inflated, floor 15 and flotation members 20*a*, 20*b* assume a rigid configuration that will not sink under the weight of a victim lying on the surface of floor 15.

Floor 15 and flotation members 20*a*, 20*b* may be in open communication with one another, allowing the entire structure to be manually (e.g., by mouth or pump, or via a source of compressed air or gas) inflated through a single valve 23. Alternatively, the raft 10 may carry a cylinder charged with a supply of compressed gas for automatic inflation. It may also prove desirable to manufacture the floor and flotation members separately and later join them with an appropriately waterproof adhesive or by heat or RF sealing techniques, necessitating separate inflation valves for each component.

A key element of this embodiment is a series of openings or windows 25 through floor 15. These windows, preferably spaced equidistantly from one another and distributed evenly along the longitudinal extent of floor 15, provide means for a victim to draw himself onto the raft and climb onto a boat. Each window preferably spans most of the transverse extent of floor 15 between flotation members 20*a*, 20*b*. The corners of the windows 25 are preferably rounded, a feature that spreads the forces exerted by a climbing victim, extending the life of the raft and reducing the chances of breakage.

The number of windows 25 may be limited by the need to maintain buoyancy of the raft 10 and the rigidity of floor 15, which desirably supports a prone victim above the surface of the water. On the other hand, windows 25 should be of sufficient number and spaced closely enough to one another to permit a victim conveniently to grasp them, one after another, as he hauls himself onto the floating raft 10.

As shown in FIG. 2, the raft 10 also includes one or more pairs of cloth or nylon straps 30 attached to, for example, flotation members 20*a*, 20*b*, and which may be buckled together or otherwise engaged. Preferably, one strap of each pair is adjustable in length, and the pair of straps join by means of a quick-release buckle or VELCRO strip. The victim can thereby be secured to floor 15. At least one pair of straps is preferably mounted at a longitudinal position corresponding approximately to the location of the chest of a victim lying fully on floor 15. Buckling this pair of straps across the victim's chest and underneath his arms provides a harness that retains the victim against the raft 10 when it is lifted vertically from the water, as described in greater detail below.

As shown most clearly in FIG. 1, the bodies of flotation members 20*a*, 20*b*, when inflated, rise above the surface of floor 15, thereby providing restraints against excessive transverse movement of a victim lying thereon. In particular, flotation members 20*a*, 20*b* retain a victim within the raft 10 just as the frame of a litter prevents a victim from rolling out of the litter.

Mounted on or integral with each flotation member 20*a*, 20*b* of the illustrated embodiment is a longitudinal edge strip 33 containing a series of graspable perforations 35. Edge strips 33 can be utilized by rescuers to manipulate the raft 10 during operation, and can also function as lifelines which may be grasped by multiple victims, all of whom cannot fit onto the floor 15.

Joined to the bow of the raft 10 is a lifting assembly, which is preferably detachable, for drawing the raft 10 onto a rescue craft. In the illustrated embodiment, the lifting assembly includes a pair of suspending ropes 40, 42 which loop through reinforced apertures in floor 15 or are otherwise suitably attached thereto (e.g., by means of heavy-duty snap clips). Suspending ropes 40, 42 are coupled to a winch rope 44 by means of a ring coupling 46. Winch rope 44 may, for example, be coupled to the winch of a rescue boat, which winds the rope and thereby draws the victim and the raft 10 onto the boat. In this mode of operation, it is useful to have the victim's chest securely held against floor 15 by a transverse strap with the victim's arms thereover, as noted previously, in order to form a retaining harness that prevents the victim from falling from the raft.

A ladder assembly, secured to the opposite end of the raft 10, includes a pair of suspending ropes or belts 50, 52, which are likewise attached to floor 15. Ropes 50, 52 are joined by a series of transverse ropes or belts 60, which form a ladder 62 that an uninjured victim can use to climb onto the raft 10. The components of ladder 52 can be constructed, for example, from coated or uncoated webbing.

In operation, ladder 62 (which may be weighted at its terminus) descends into the water. A victim grasps the ladder 62 as the raft 10 approaches him, using it to begin his climb onto floor 15. Ladder 62 also serves as a drogue chute that prevents excessive wind drift. This latter function can be enhanced through use of the alternative ladder configuration illustrated in FIG. 2, which more closely resembles the conventional rung-and-upright arrangement and therefore presents more surface area to the water. The configuration shown in FIG. 1 is designed provide an alternative towing site.

Figure 3:
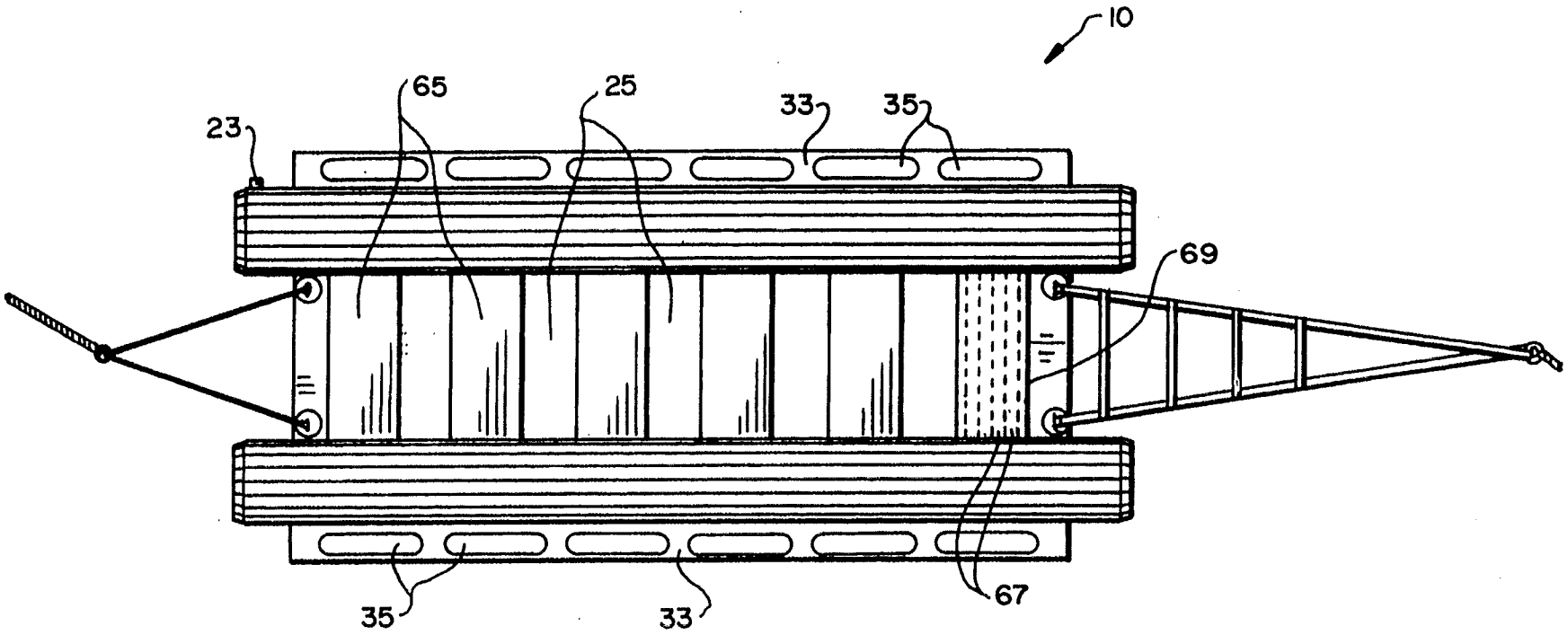
FIG. 3 is a plan view of a second embodiment of the present invention.

Refer now to FIG. 3, which illustrates the second embodiment of the invention, in which windows 25 are formed by a series of inflatable, transverse bladders 65 that each span flotation members 20*a*, 20*b*. As shown in the cutaway portion of the drawing, each bladder 65 is formed from a series of inflation tubes 67, which are bundled together and open to either flotation member or to both members, thereby facilitating their inflation as the flotation members are inflated. For example, for ease of manufacture it is possible to alternate the open side of the inflation tubes, so that successive bladders communicate with opposite flotation members. Inflation tubes 67 are wrapped in a sturdy (preferably webbed nylon) step cover 69, each side of which is secured to one of the flotation members (preferably by sealing or adhesive). The covered bladders serve as rigid floor segments as well as ladder rungs.

Figure 4:
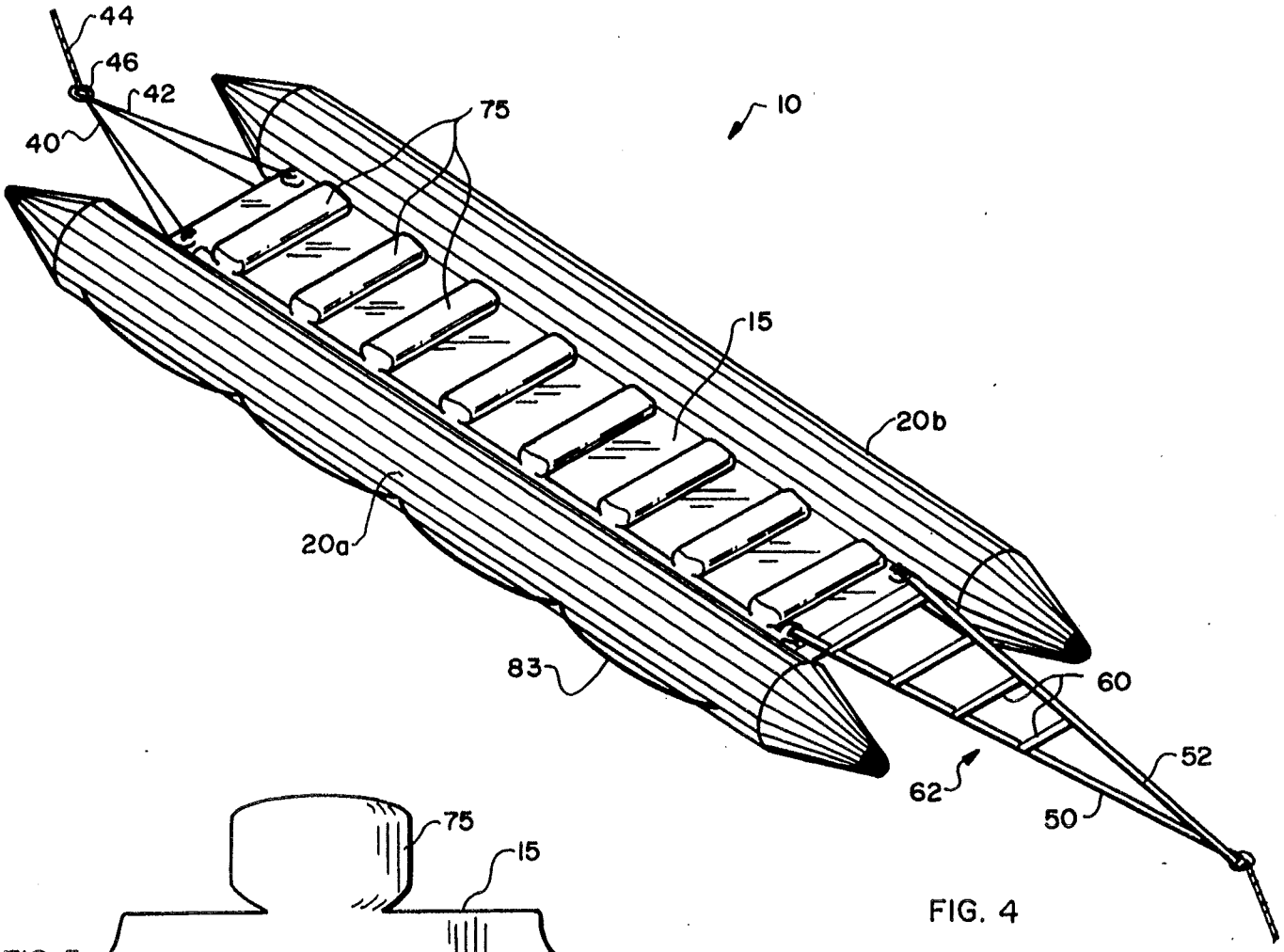
FIG. 4 is an isometric view of a third embodiment of the invention.
Figure 5:
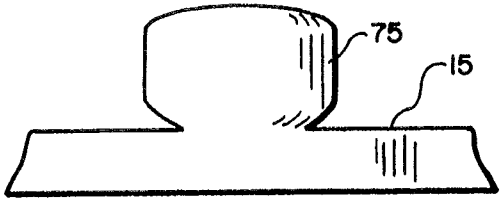
FIG. 5 is an enlarged sectional view of a single cushion member of the third embodiment.

FIGS. 4 and 5 illustrate the third embodiment of the invention, in which the windows have been replaced with a series of buoyant segments or cushions 75 that project from the surface of floor 15. Cushions 75 may be inflatable bladders molded directly into floor 15, or may instead be separate buoyant (and preferably inflatable) elements secured to floor 15 by means of a suitable adhesive or sealing technique. In either case, the portion of cushions 75 that joins to floor 15 should be necked down as shown in FIG. 4, or the cushions themselves bear projecting ridges, so that a victim's hand can wrap around the cushion or portion thereof as he grasps it.

This embodiment offers the advantages of additional buoyancy, and also supports a prone victim farther above the surface of the water.

Figure 6:
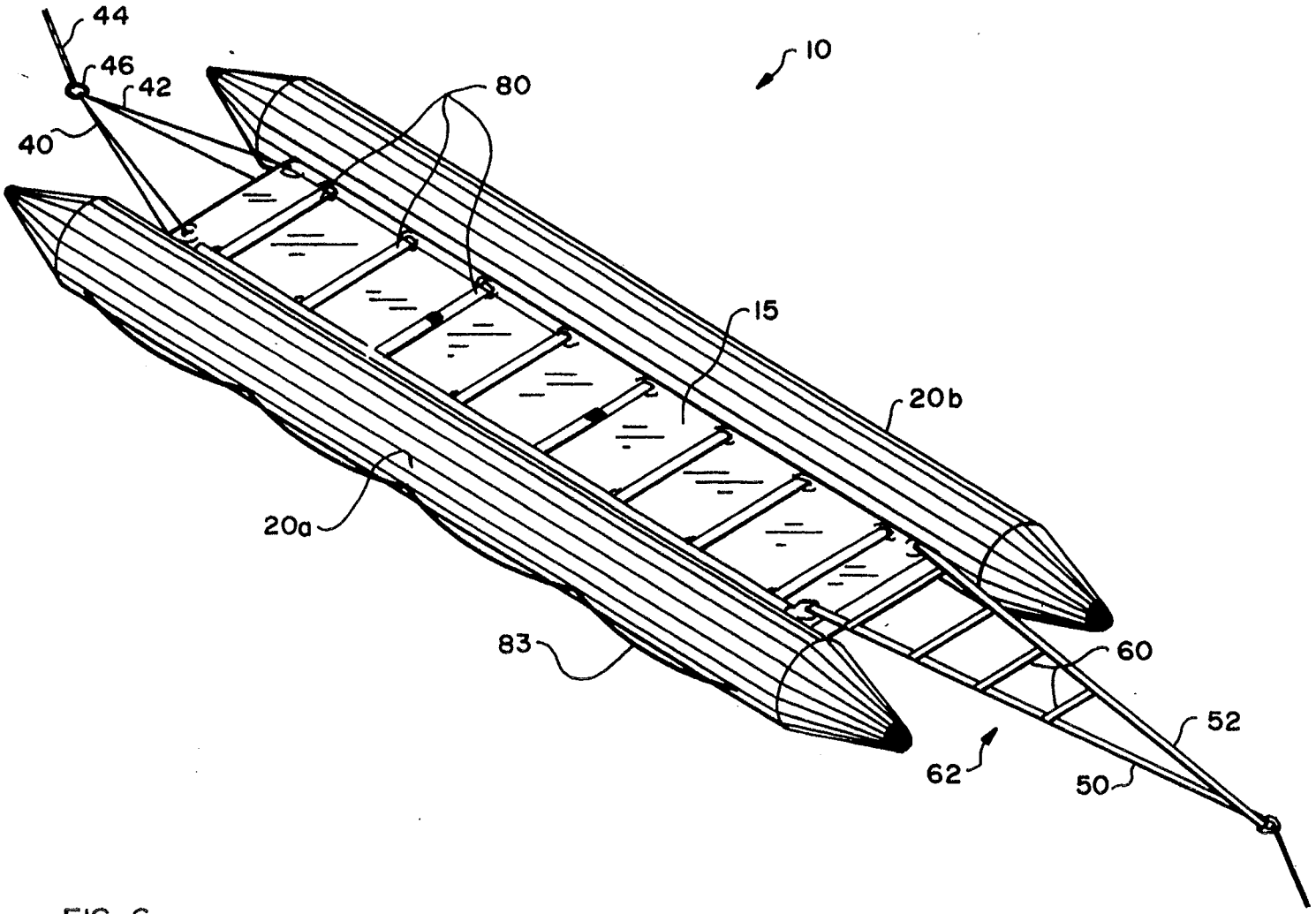
FIG. 6 is an isometric view of a fourth embodiment of the invention.
Figure 7:
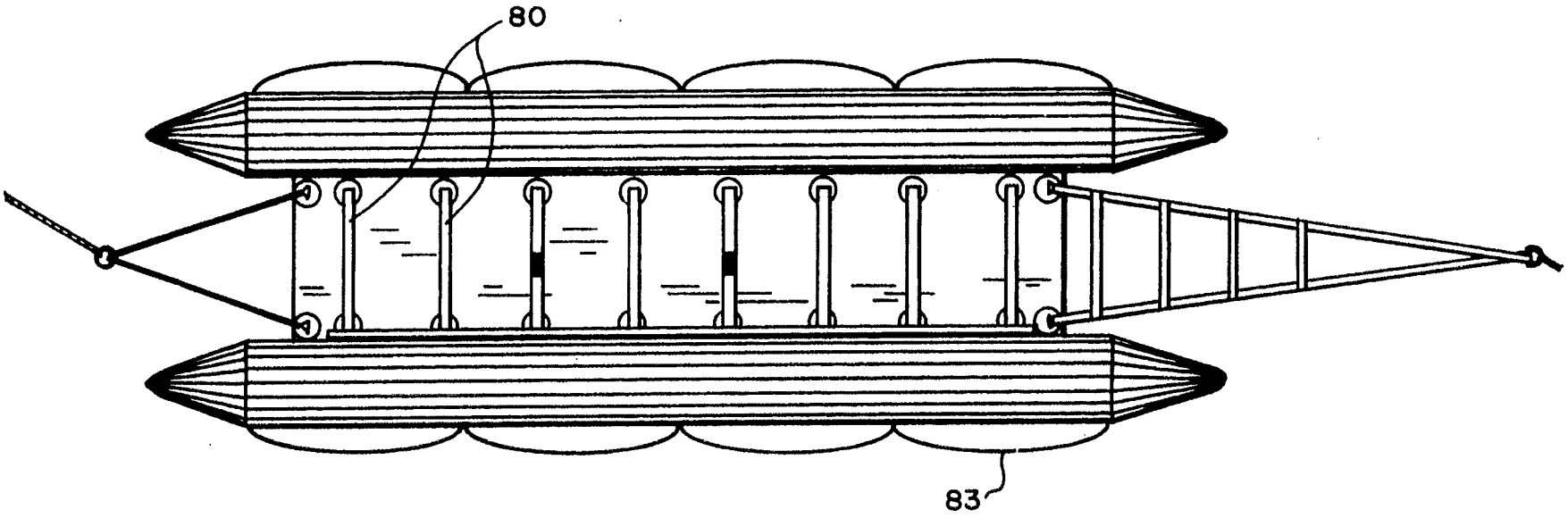
FIG. 7 is a plan view of the device depicted in FIG. 6.

In the fourth embodiment of the invention, shown in FIGS. 6 and 7, the graspable members are a series of transverse straps 80 that run along floor 15. At least some of these straps, which may be fabricated from any sturdy material such as cloth or nylon, are equipped with buckles or VELCRO strips that allow them to be strapped around a victim. In other words, the function performed by straps 30 of the other embodiments is herein performed by the graspable members themselves, resulting in added convenience and manufacturing efficiency. Transverse straps 80 serve essentially the same function as windows 25, allowing the victim to pull himself onto the raft and, when the raft is lifted to a vertical orientation, forming ladder rungs that enable the victim to enter the rescue boat. Straps 80 are secured to floor 15 or to flotation members 20*a*, 20*b* by means of suitable couplings (e.g., surface-mounted rings).

Also shown in FIGS. 6 and 7 is a rope 83, secured to flotation members 20*a*, 20*b* at various points of attachment, which can be utilized in lieu of edge strips 33.

It will thus be seen that the objects set forth above, among those made apparent from the preceding description, are efficiently attained and, since certain changes may be made in carrying out the above process, in the described products, and in the constructions set forth without departing from the scope of the invention, it is intended that all matter contained in the above description or shown in the accompanying drawings shall be interpreted as illustrative and not a limiting sense. For example, the inflatable elements discussed above may be replaced with non-inflatable buoyant elements, fabricated from a material such as hollow fiberglass or dense foam.

It is also to be understood that the following claims are intended to cover all of the generic and specific features of the invention herein described.

What is claimed is:

1. A rescue raft comprising:

a. a buoyant, elongated floor;

b. flotation means, associated with the floor and having sufficient buoyancy to prevent the floor and a victim thereon from sinking; and c. a series of graspable members associated with the floor and distributed sequentially along its longitudinal extent, the graspable members facilitating entry onto the raft, wherein at least one of the floor and the flotation means is inflatable and the graspable members comprise at least one of (i) windows through the floor, (ii) buoyant cushions that project from the floor, and (iii) transverse buoyant segments extending between two flotation means.

2. The raft of claim 1 wherein the graspable members form a ladder which, with the raft oriented vertically, facilitates entry onto a rescue craft.

3. The raft of claim 1 wherein the graspable members are windows through the floor.

4. The raft of claim 1 wherein the graspable members are buoyant cushions that project from the floor.

5. The raft of claim 1 wherein the graspable members are transverse buoyant segments extending between two flotation means.

6. The raft of claim 1 wherein the flotation means comprises first and second inflatable flotation members disposed on opposite sides of the floor.

7. The raft of claim 6 wherein the flotation members are inflatable, cylindrical air chambers each fastened to the floor and extending at least its longitudinal length.

8. The raft of claim 6 wherein the floor is generally planar and the flotation members rise at least in part above the plane of the floor.

9. The raft of claim 1 further comprising graspable members associated with at least one edge of the raft.

10. The raft of claim 1 wherein the floor and the flotation means are inflatable.

11. A rescue raft comprising:

a. a buoyant, elongated floor;

b. flotation means, associated with the floor and having sufficient buoyancy to prevent the floor and a victim thereon from sinking; and c. a series of graspable members associated with the floor and distributed sequentially along its longitudinal extent, the graspable members facilitating entry onto the raft; and d. a lifting assembly, extending from one end of the raft, which includes a series of straps that can function as a ladder, wherein at least one of the floor and the flotation means is inflatable and the graspable members comprise at least one of (i) windows through the floor, (ii) straps extending transversely across the floor, (iii) buoyant cushions that protect from the floor, and (iv) transverse buoyant segments extending between two flotation means.

12. The raft of claim 11 wherein the lifting assembly is detachable.

13. A rescue raft comprising:

a. a buoyant, elongated floor;

b. flotation means, associated with the floor and having sufficient buoyancy to prevent the floor and a victim thereon from sinking; and c. a series of exposed graspable members extending transversely across the floor and distributed sequentially along its longitudinal extent, the graspable members comprising at least one of (i) transverse buoyant segments extending between two flotation means; (ii) windows through the floor; and (iii) buoyant cushions that project from the floor.

14. The raft of claim 13 wherein the flotation means comprises a pair of cylindrical air chambers each fastened to the floor and extending at least its longitudinal length.

15. The raft of claim 13 wherein the floor and the flotation means are inflatable.

16. The raft of claim 13 wherein the graspable members are transverse buoyant segments extending between two flotation means.

17. The raft of claim 13 wherein the graspable members are windows through the floor.

18. The raft of claim 13 wherein the graspable members are buoyant cushions that project from the floor.

19. The raft of claim 18 wherein the cushions are inflatable.

* * * * *